US007418793B2

(12) United States Patent
Dominguez et al.

(10) Patent No.: US 7,418,793 B2
(45) Date of Patent: Sep. 2, 2008

(54) NOVELTY FOOTWEAR ITEM WITH STASH

(75) Inventors: Bonnie Dominguez, San Francisco, CA (US); James Darr Burress, Del Mar, CA (US); Amy Lynn McMahan, San Marcos, CA (US); Ryan William Quinn, San Diego, CA (US); Eric Simmons, San Diego, CA (US); Brett D. Ritter, Del Mar, CA (US)

(73) Assignee: South Cone, Inc.

( * ) Notice: Subject to any disclaimer, the term of this patent is extended or adjusted under 35 U.S.C. 154(b) by 0 days.

(21) Appl. No.: 11/820,691

(22) Filed: Jun. 20, 2007

(65) Prior Publication Data

US 2008/0110053 A1 May 15, 2008

(51) Int. Cl.
*A43B 23/00* (2006.01)

(52) U.S. Cl. ..... 36/136; 36/132

(58) Field of Classification Search ..... 36/136, 36/132, 1

See application file for complete search history.

(56) References Cited

U.S. PATENT DOCUMENTS

| | | | | |
|---|---|---|---|---|
| 0,032,490 | A | 6/1861 | Towers | |
| 0,922,499 | A | 5/1909 | Molitor | |
| 1,085,254 | A | 1/1914 | Halley | |
| 2,478,411 | A * | 8/1949 | Martin | 36/1 |
| 2,507,991 | A | 5/1950 | Neal | |
| 2,904,901 | A * | 9/1959 | Goldstein | 36/1 |
| 5,231,776 | A | 8/1993 | Wagner | |
| 5,285,586 | A * | 2/1994 | Goldston et al. | 36/137 |
| 5,692,324 | A | 12/1997 | Goldston et al. | |
| 5,921,008 | A * | 7/1999 | Ruff | 36/136 |
| 6,094,844 | A | 8/2000 | Potts | |
| 6,898,875 | B2 | 5/2005 | Ruff | |

* cited by examiner

*Primary Examiner*—Ted Kavanaugh
(74) *Attorney, Agent, or Firm*—Jerry R. Potts

(57) ABSTRACT

A novelty footwear item includes a mid-sole foot platform for supporting from below the foot of a user, an outer sole for providing the footwear item with turning traction and a stash assembly sandwiched between the mid-sole foot platform and the outer sole, wherein said stash assembly has disposed therein a slidably removable comb sufficient width, length and depth dimensions for storage therein of loose items.

21 Claims, 8 Drawing Sheets

FIG. 1
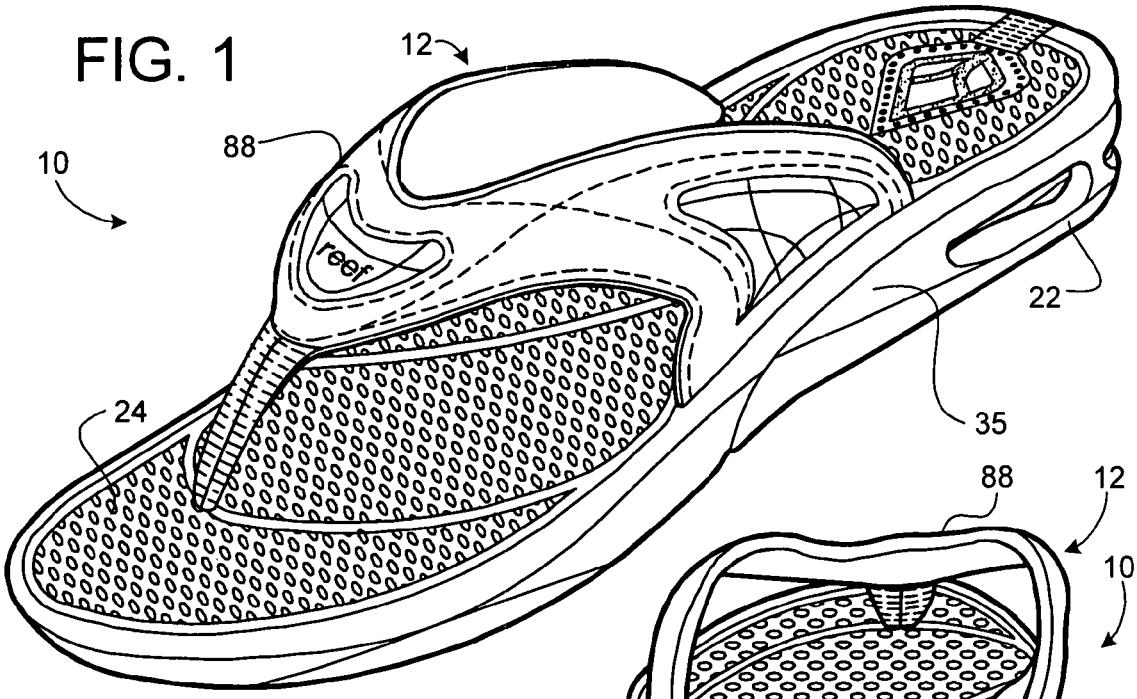
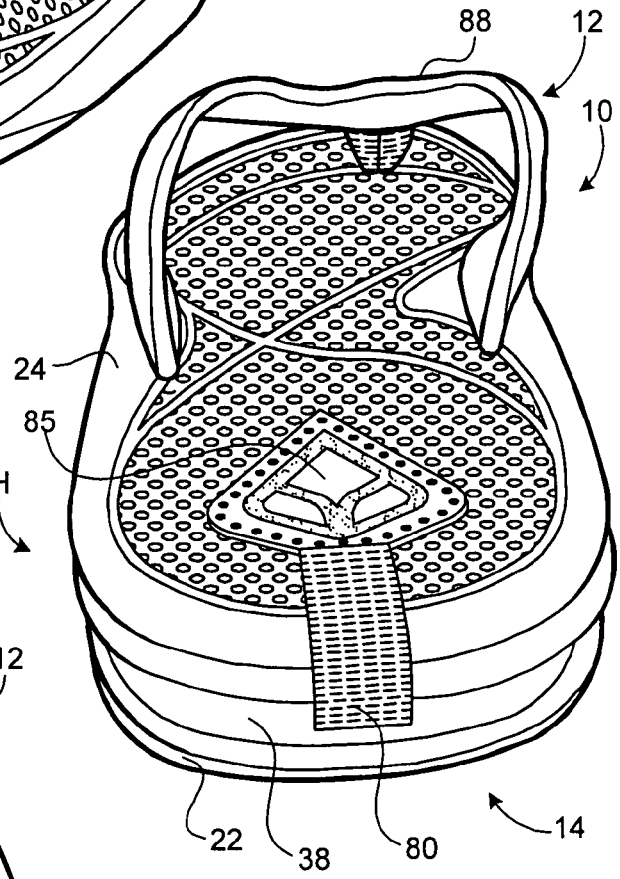
FIG. 2
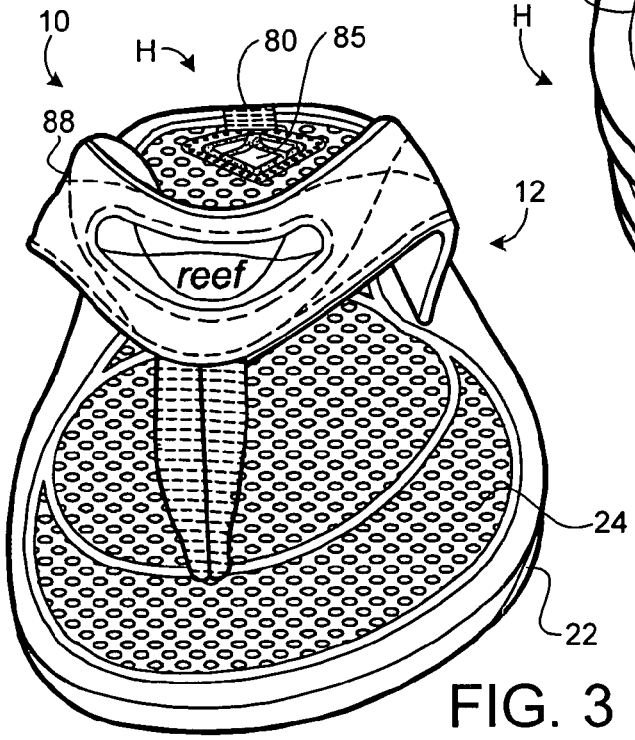
FIG. 3

FIG. 16
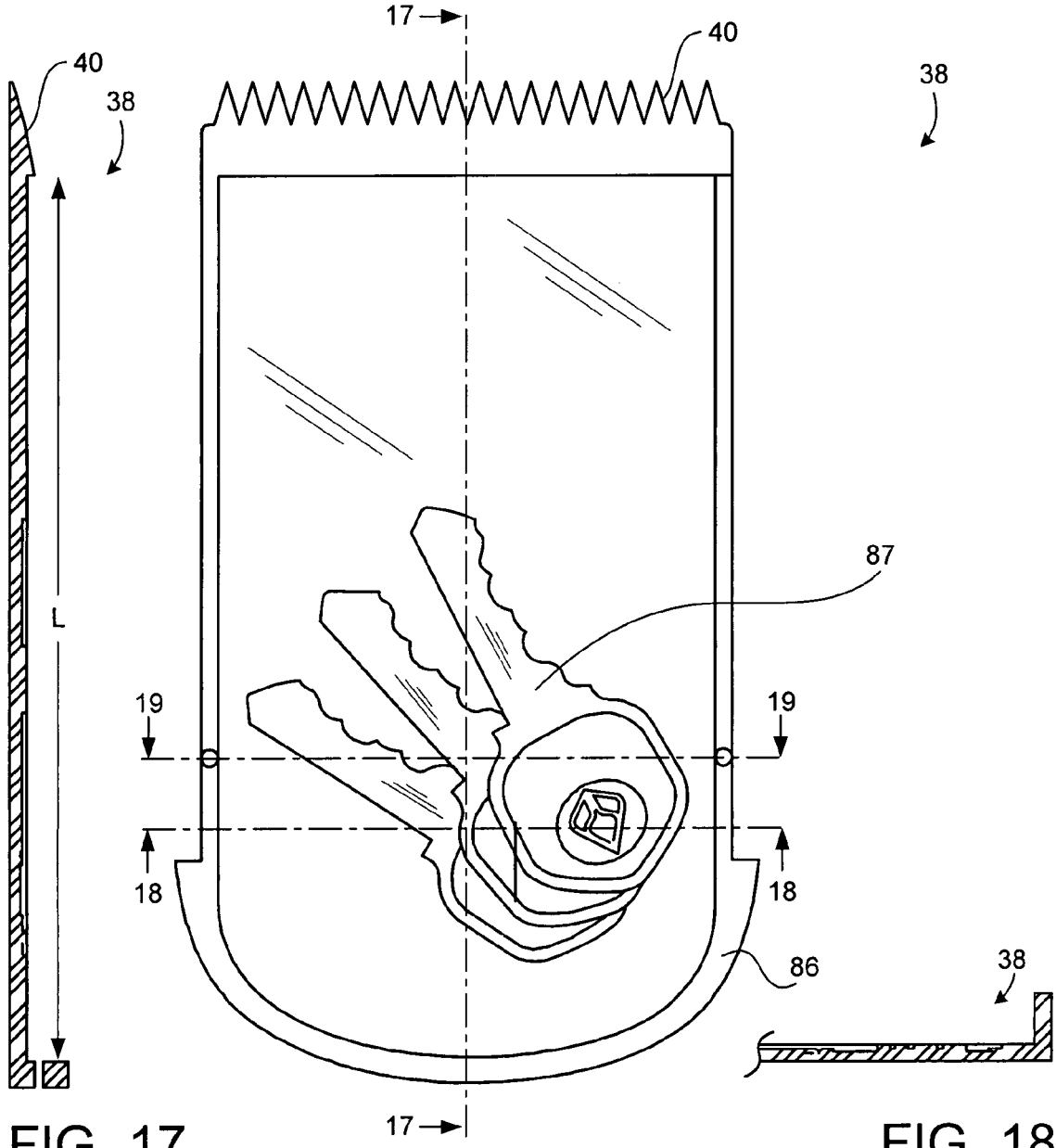
FIG. 17
FIG. 18
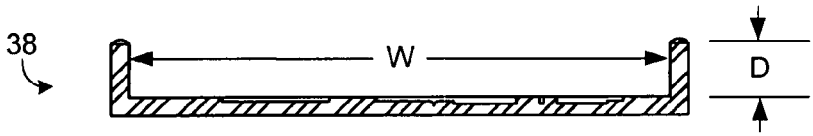
FIG. 19

NOVELTY FOOTWEAR ITEM WITH STASH

BACKGROUND OF THE INVENTION

This invention relates generally to novelty footwear and more particularly to a combination sandal and cassette-like comb which has sufficient length, width and depth dimensions to facilitate the temporary storage of small loose items, such as coins, keys, and paper currency within the novelty footwear.

PRIOR ART

When wearing footwear at the beach, park or other places of outdoor relaxation and entertainment it may be necessary to carry loose items such as keys, coins and paper currency while in such venues. Therefore, it would be highly desirable to have a new and improved novelty footwear item that permits a user to carry one or more loose items in a concealed manner within the footwear while further providing the user with a unique utility tool such as a comb.

SUMMARY OF THE INVENTION

A new and improved novelty footwear item includes a mid-sole foot platform for supporting from below the foot of a user, an outer sole for providing the footwear item with turning traction and a stash assembly sandwiched between the mid-sole foot platform and the outer sole, wherein said stash assembly has disposed therein a slidably removable comb sufficient width, length and depth dimensions for storage therein of loose items.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings wherein:

FIG. 1 is a right-side perspective view of a novelty footwear item, which is constructed in accordance with a preferred embodiment the present invention;

FIG. 2 is a rear perspective view of the novelty footwear item of FIG. 1;

FIG. 3 is front perspective view of the novelty footwear item of FIG. 1;

FIG. 13 is a top plan view of the stash drawer of FIG. 14;

FIG. 16 is a top plan view of a stash drawer forming part of the novelty footwear item of FIG. 1, illustrating a set of cut-out for key placement within the drawer;

FIG. 17 is sectional view of the stash drawer of FIG. 16 taken substantially along line 17-17;

FIG. 18 is another sectional view of the stash drawer of FIG. 16 taken substantially along line 18-18;

FIG. 16 is still yet another sectional view of the stash drawer of FIG. 16 taken substantially along line 19-19.

DETAILED DESCRIPTION OF THE PREFERRED EMBODIMENTS OF THE INVENTION

Figure 4:
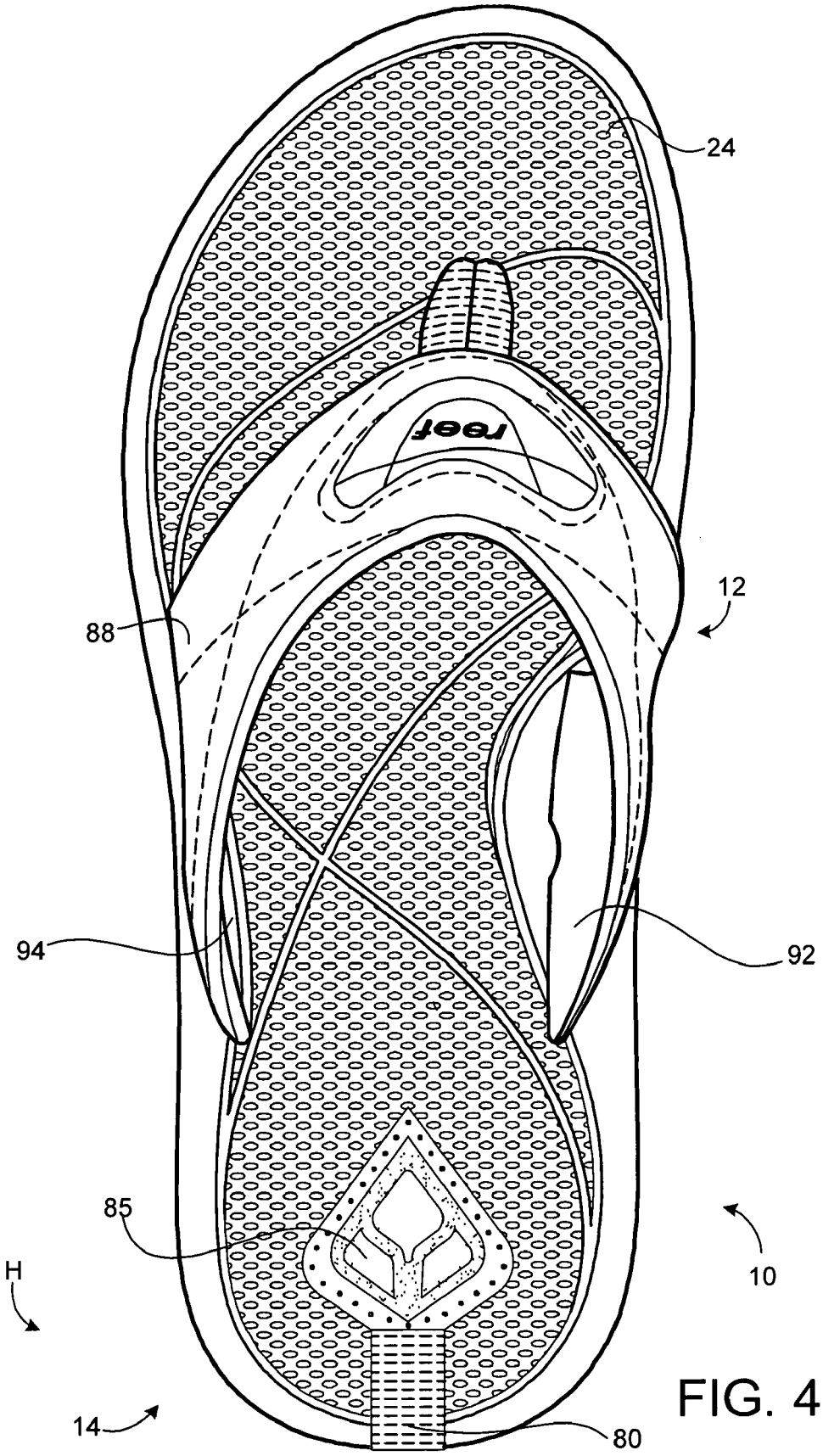
FIG. 4 is top plan view of the novelty footwear item of FIG. 1.

Referring now to the drawings and more particularly to FIGS. 1-6 there is shown an illustrative preferred embodiment of a sandal or novelty footwear item 10, which is constructed in accordance with the present invention. The novelty footwear item 10 when used in accordance with a novel method of using the footwear item 10, not only protects and supports the foot of a user (not shown) with an attractive fashion wear appearance but also provides a novelty footwear item which provides the user with an easily accessed utility tool for use on a surfboard as will be explained hereinafter in greater detail. The unique utility tool integrated into the footwear item 10 also provides the user with an easily accessed storage arrangement which has a sufficient volume for storage of small items such as keys, coins and the like.

Considering the novelty footwear item 10 in greater detail with reference to FIGS. 1-11, the novelty footwear item 10 generally comprises an upper or foot strap assembly 12 and a bottom or foot-shaped sole assembly 14 which is held to the foot of the user by the foot strap assembly 12. The upper 12 and bottom 14 in combination, provide the foot of the user with an attractive fashion wear appearance.

Figure 11:
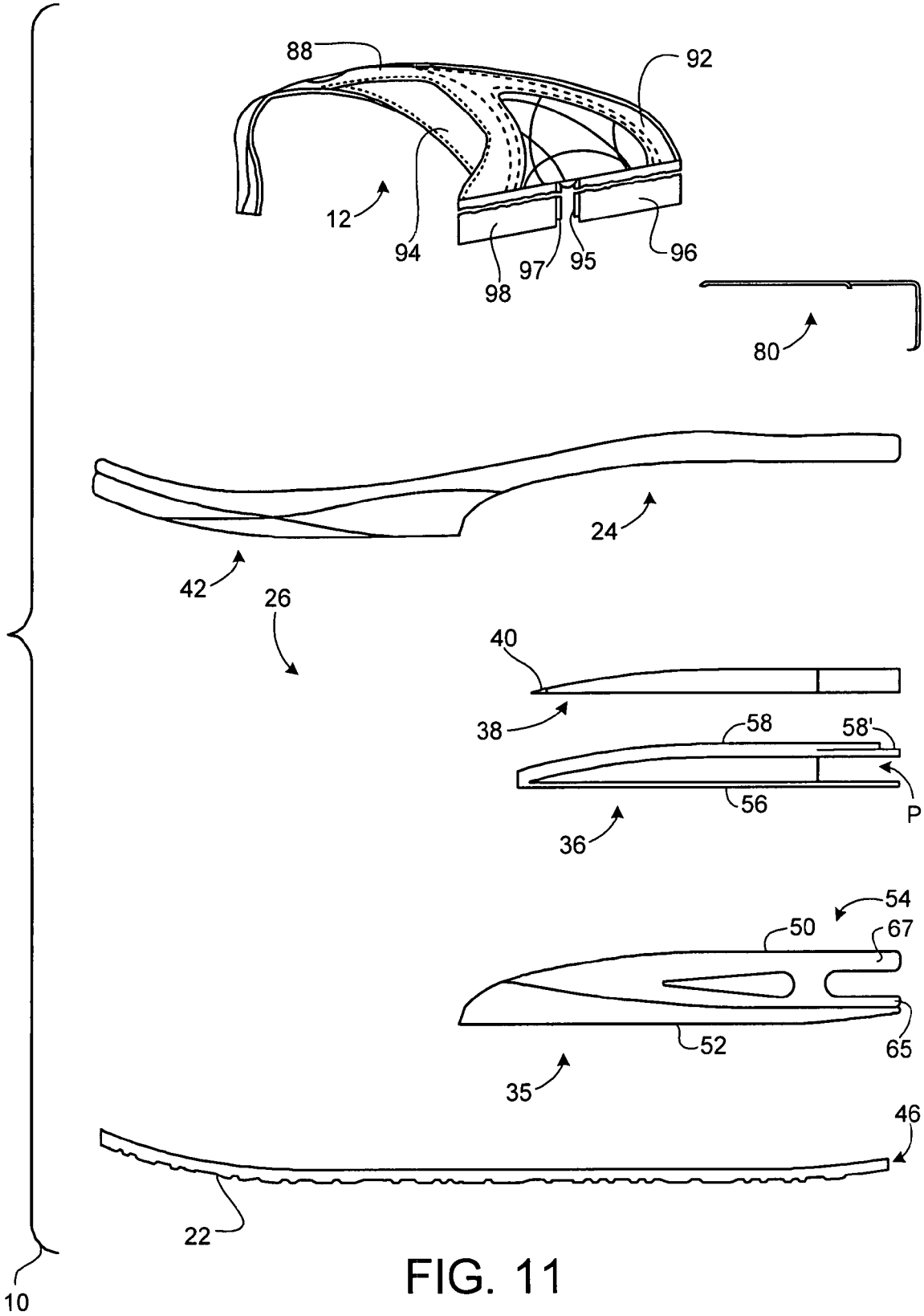
FIG. 11 is an exploded view of the footwear item of FIG. 1.

Considering now the top or strap assembly 12 in greater detail with reference to FIGS. 1-6 and 11, the strap assembly 12 has a unitary construction which generally includes a foot or main body strap 88 having extending therefrom a front strap 90, a medial side strap 92 and a lateral side strap 94. Extending from the distal end of the medial-side strap 92 is a pair of narrow finger anchoring straps, indicated generally at 95 and 96 respectively. As best seen in FIG. 11, the anchoring straps 95, 96 have sufficient lengths and widths to be adhesively secured to the sole assembly 14 as will be explained hereinafter in greater detail. In a similar manner, extending from the distal end of the lateral-side strap 94 is another pair of narrow finger anchoring straps, indicated generally at 97 and 98 respectively. The anchoring straps 97 and 98, like the anchoring straps 95, 96 also have sufficient lengths and widths to be adhesively secured to the sole assembly 14 as will be explained hereinafter in greater detail.

Considering now the bottom or sole assembly 14 in greater detail with reference to FIGS. 1-6 and 11, the sole assembly 14 generally comprises an outer sole 22 for providing the footwear item with good ground traction, a foot-platform or mid-sole 24 for supporting from below the underside of the foot of a user, and a stash assembly 26 which is sandwiched between the outer sole 22 and the foot-platform 24 at about the heel end of the footwear, indicated generally at H. As noted earlier, the stash assembly 26 provides the user of the footwear 10 with provides the user with an easily accessed utility tool for use on a surfboard as well as will an easily accessed storage arrangement which has a sufficient volume for the storage of small items such as keys, coins and the like.

Figure 10:
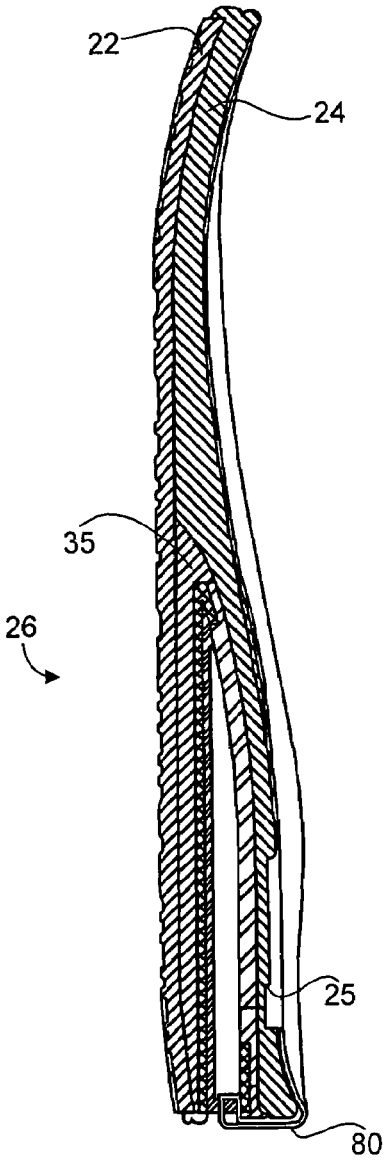
FIG. 10 is a sectional view of the footwear item of FIG. 7, taken substantially along line 10-10 thereof.

Considering now the stash assembly 26 in greater detail with reference to FIGS. 10-11, the stash assembly 26 generally includes a soft flexible retainer 35, a cassette-like compartment 36 which is received within the retainer 35, and an elongated comb, in the form of a stash drawer 38. The retainer 35 which is configured to receive and retain therein the cassette-like compartment or storage box 36, in combination with one another provides the footwear item 10 with a heel support and an arch support that will be explained hereinafter in greater detail.

As best seen in FIGS. 2 and 12-15, the hollow cassette-like box 36 is dimensioned for slidably receiving therein an elongated comb 40, which is disposed on the distal end of the stash drawer 38. Although in the preferred embodiment of the present invention the comb 40 is disclosed as being in the form of a surfboard wax comb, it is contemplated that the comb could also be in the form of different types of combs, such as for example, a hair comb.

Figure 15:
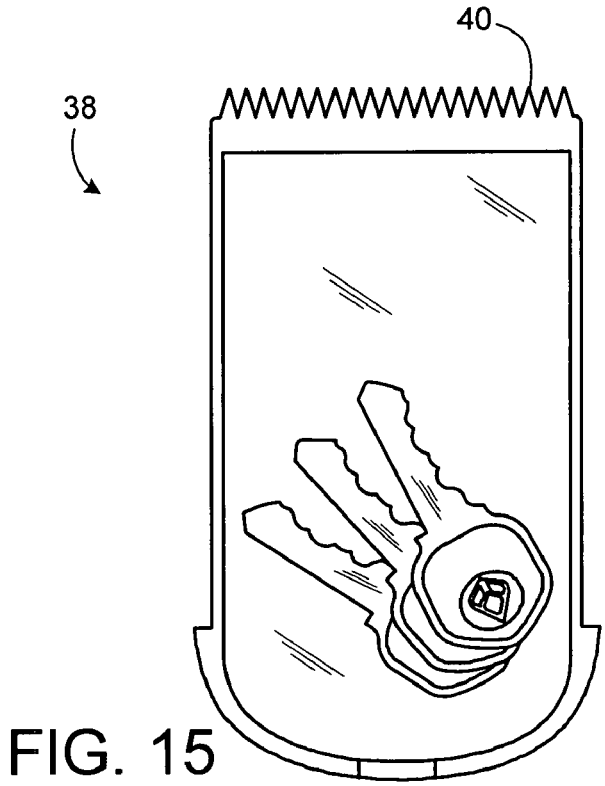

As previously mentioned and as best seen in FIG. 15, the comb 40 is disposed on the distal end of the stash drawer 38 which has sufficient length (L), width (W) and depth (D) dimensions for the storage of loose items when the drawer 38 is disposed within the cassette-like box 36. When the drawer 38 is slidably received within the cassette-like box 36, the drawer 38 locks into place in a friction tight fit for providing the user with a sufficient volume and storage area within the footwear item for the temporary storage of small items such as keys, coins, paper money and other paper items like a fishing license or the like.

In order to assist the user is unlocking the stash drawer 38 from its locking engagement within the cassette box 36, the stash assembly 26 also includes a pull tab or strap 80 which is removably attached to the stash drawer and which is configured to be secured to a top surface area of the foot platform 24 as will be explained hereinafter in greater detail. Each of the footwear item components will be described hereinafter in greater detail.

Figure 7:
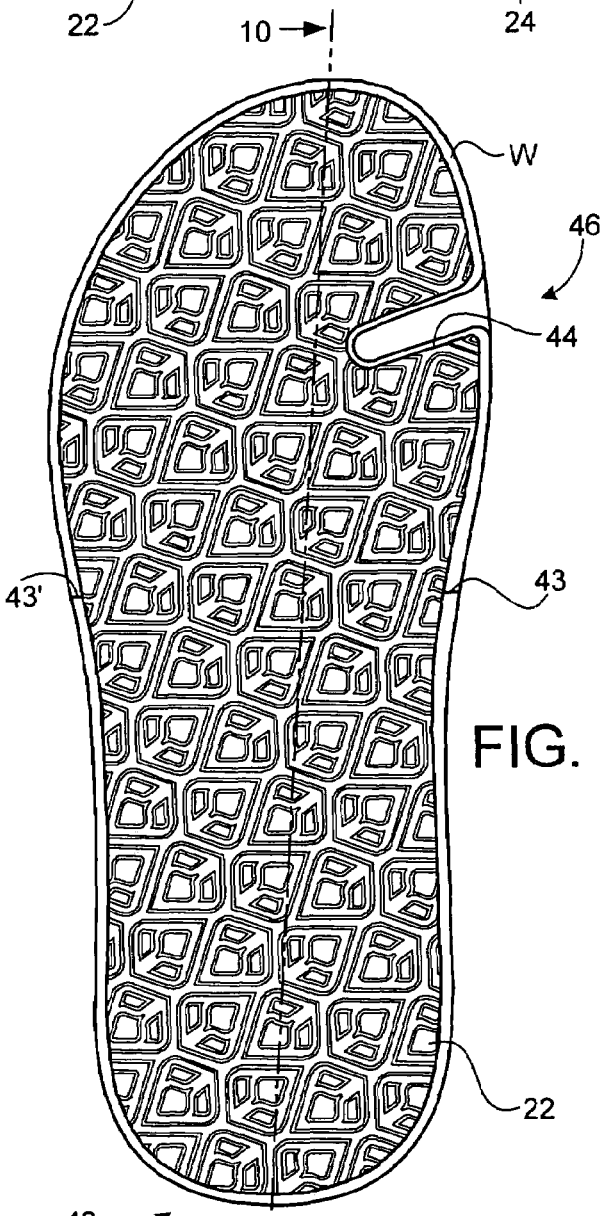
FIG. 7 is a bottom plan view of the novelty footwear item of FIG. 1.

Considering now the outer sole 22 in greater detail with reference to FIGS. 7-10, the outer sole 22 is shaped to be received within an outer sole retaining area of the mid-sole 24, which outer sole retaining area is indicated generally at 42. For the purpose of helping to align the outer sole 22 within the outer sole retaining area 42, the mid-sole 24 includes a front retaining wall, which extends between wall end points 43 and 43' as best seen in FIG. 7. To further facilitate the proper alignment of the outer sole 22 within the outer sole retaining area 42, the mid-sole 24 further includes an inwardly projecting alignment wall indicated generally at 44. In this regard, the outer sole 22 has a notch or cutout 46 that is dimensioned to align about the alignment wall 44. When the outer sole 22 is properly aligned within the outer sole retaining area 42 of the mid-sole 24, a cassette retainer space is then formed between the outer sole 22 and the mid-sole 24, which extends from about the wall end points 43 and 43' to the distal ends of the outer sole 22 and mid-sole 24, indicated generally at 46 and 48 respectively. The cassette retainer space has a sufficient volume and area for receiving therein the cassette component retainer 35 as best seen in FIG. 10.

In order to provide proper alignment between the outer sole 22 and the mid-sole 24 relative to the cassette component retainer 35, the cassette component retainer 35 includes an upper retainer wall indicated generally at 50 and a lower retainer wall indicated generally at 52. In this regard, the upper retainer wall 50 has a sufficient height and boundary area to receive therein in alignment a rear or heel portion of the mid sole 24. In a similar manner, the lower retainer wall 52 has a sufficient height and boundary area to receive therein in alignment a rear or heel portion of the outer sole 22. From the foregoing, and as best seen in 1-6, those skilled in the art will understand that the outer sole 22 and the mid-sole 24 are sandwiched together at about the front part of the sandal extending rearwardly to about the mid-point of the sandal and then the outer sole 22 and the mid sole 24 are sandwiched apart from one another and about the stash assembly 26 to provide the footwear 10 with a pleasing rear heel appearance.

Figure 5:
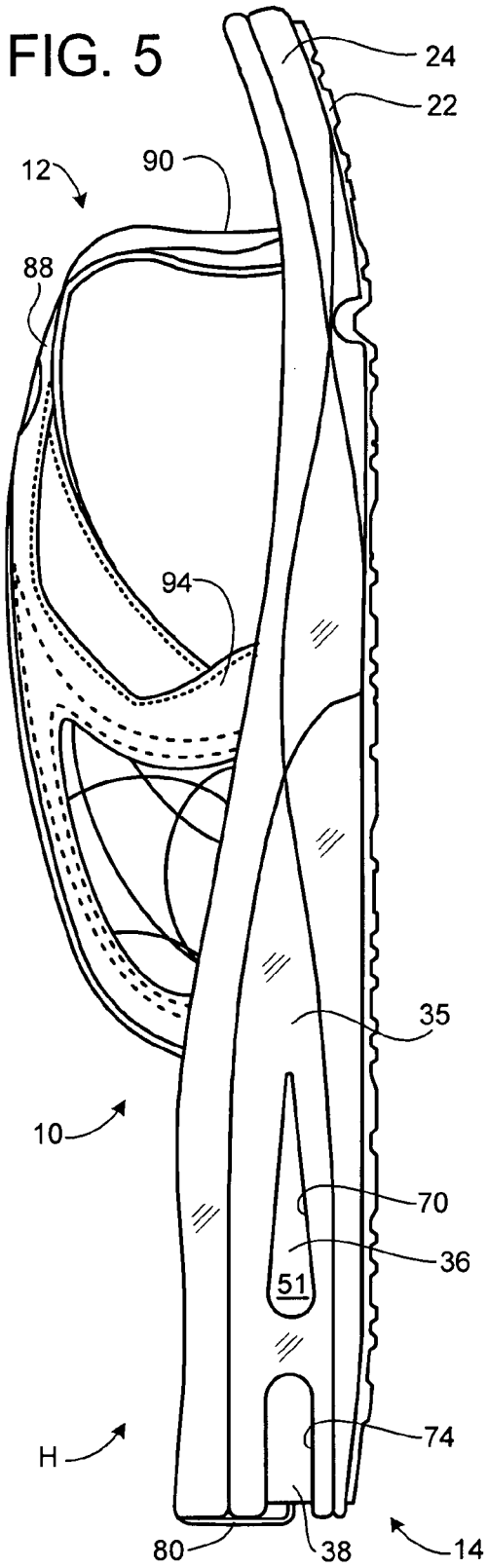
FIG. 5 is a right side elevational view of the novelty footwear item of FIG. 1.
Figure 6:
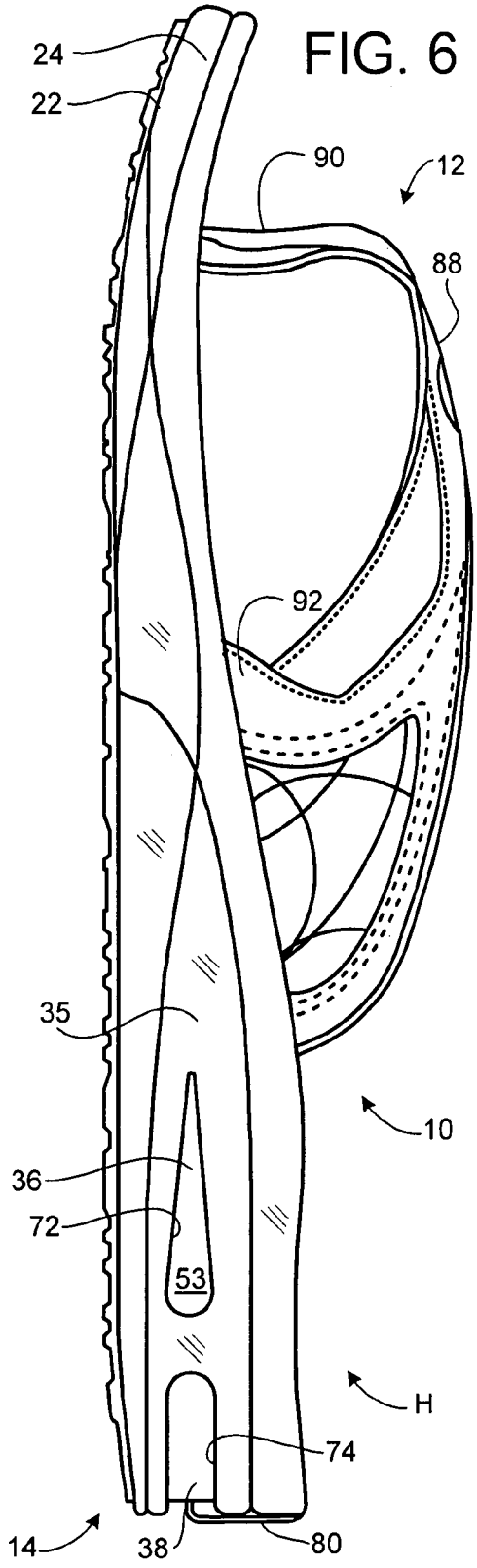
FIG. 6 is a left side elevational view of the novelty footwear item of FIG. 1.
Figure 8:
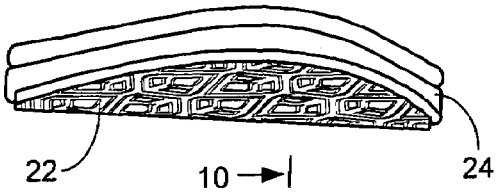
FIG. 8 is a front elevational view of the novelty footwear item of FIG. 1 with its strap assembly removed.

As best seen in FIGS. 5-6, the retainer 35 is also provided with a plurality of decorative windows, such as the decorative windows, such as the windows 70 and 72 respectively. The purpose of the decorative windows 70, 72, is to enable a user to see the sidewalls 51 and 52 of the cassette-like box 36, which is disposed within the retainer 35. In this regard, since the box 36 functions as an ornamental insert to provide the footwear 10 with a decorative heel and arch support which in turn provides the footwear with a pleasing ornamental feature.

Considering now the mid-sole 24 in still greater detail with reference to FIGS. 1-6, the mid-sole 24 has a foot-platform configuration dimensioned to receive thereon and support from below the under foot of the user. The mid-sole is composed of soft cushioning mater, such as ethylene vinyl acetate (EVA), which provides a stable and easily tolerated platform for supporting and cushioning the foot of the user. As noted earlier, the mid-sole 24 is constructed to engage and to be secured adhesively to the strap assembly 12, the outer sole 22 and the stash assembly 26 to function to not only support the foot and heel of the user in a comfortable manner but also to function to help provide a storage area and ready access to the wax comb 40.

While the mid-sole 24 has been describes as being composed of ethylene vinyl acetate (EVA) is should be understood by those skilled in the art, that the mid-sole 24 may be composed of a wide variety of flexible materials, such as thermoplastic, thermosetting polymer compounds, foam polyurethane plastic or foam rubber. Ethylene vinyl acetate (EVA) is a preferred material because of its hardness and density which provides the user with a relatively soft cushioning like platform that facilitates foot comfort.

Considering now the outer sole 22 in still greater detail with reference to FIGS. 2 and 7, the outer sole 22 is composed of a wide variety of flexible materials, such as rubber compounds, thermoplastic, thermosetting polymer compounds, foam polyurethane plastic, foam rubber and ethylene vinyl acetate. A rubber compound is a preferred material, which is sufficiently durable to function over an extended period of time as a wear surface for engaging the ground and providing the footwear 10 with the ability to grip and maintain traction with the ground. Also since the bottom surface of the outer sole 22 is highly visible, the bottom surface of the outer sole 22, as best seen in FIG. 7, bears a unique non-skid stylized pattern which functions to prevent the footwear item 10 from slipping on the ground, to provide the footwear item 10 with traction and to provide the outer sole 22 with an attractive appearance. As will be explained hereinafter in greater detail, the outer sole 22 also functions for facilitating transferring the dynamic energy imparted by the user to the footwear item 10 into controlled motion in a user desired and selected direction.

Considering now the cassette component retainer 35 in greater detail with reference to FIGS. 5-6 and 11, the cassette component retainer 35 is composed of a soft cushioning material, such as ethylene vinyl acetate (EVA), which provides a stable and easily tolerated platform for supporting and cushioning the heel of the user. As noted earlier, the retainer 35 is constructed to engage and to be secured adhesively to the mid-sole 24 a about it heel portion H. As best seen in FIG. 11, the retainer 35 includes a lower rear wall 65 and an upper rear wall 67, which walls 65, 67 engage the lower wall 56 and upper walls 58 and 58' respectively of the cassette 36 when it is received within the retainer 35. The retainer 35 also includes a pair of designer shaped windows 70 and 72 respectively as best seen in FIG. 5-6, which enable the side wall member 51 and 53 respectively of the cassette to be seen as an ornamental feature of the sandal. In this regard, the cassette 36 is formed from a brightly colored plastic material that is pleasing to the sight. Also, In order to enable a user to grasps the drawer 38 when it is disposed within the cassette 36, the cassette retainer 35 also includes a rear window indicated generally at 74

Figure 9:
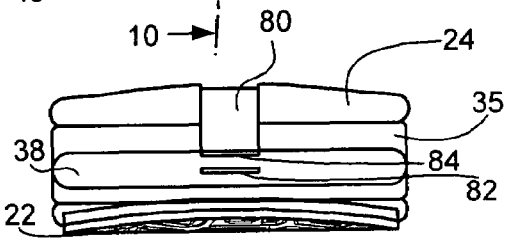
FIG. 9 is a real elevational view of the novelty footwear item of FIG. 1, with its strap assembly removed.

To further facilitate the extraction of the drawer 38 from within the cassette 36 by a user, the footwear item 10 is also provided with a decorative extraction strap 80 having a decorative emblem member 85 disposed on its distal end. The proximate end of the extraction strap 80 is looped around the rear end of the drawer 38, via a pair of elongated slots indicated at 82 and 84 respectively (FIG. 9). A cutout 25 in the shape of the emblem member 85 is disposed in the heel portion H of the mid-sole 24. The floor of the cutout 25 is provided with a series of either hooks or piles, while the underside of the emblem member 85 is also provided with a series of either hooks or piles. In this manner, when the emblem member 85 is positions within the cutout 25 it will be held in place until need by the user.

As best seen in FIGS. 5-6 and 11, the mid-sole 24 and the retainer 35 when adhesively secured together form the heel portion of the footwear 10. However, because the mid-sole and retainer 35 are both composed of ethylene vinyl acetate, which is a soft cushioning material, the resulting construction would be insufficiently stable to support the weight of the user and would thus, collapse under the weight of the user. In order to prevent the heel portion of the footwear 10 from collapsing, the retainer 35 includes a generally rectangular shaped cutout 54 having a sufficient volume for receiving therein in a snug friction tight fit, the hollow box 36, which is composed of a hard plastic material. In this regard, this material is sufficiently hard that it will not collapse or crush under the weight of a user so it provides the heel portion H of the sandal 10 with the necessary strength to support the weight of a user.

Figure 12:
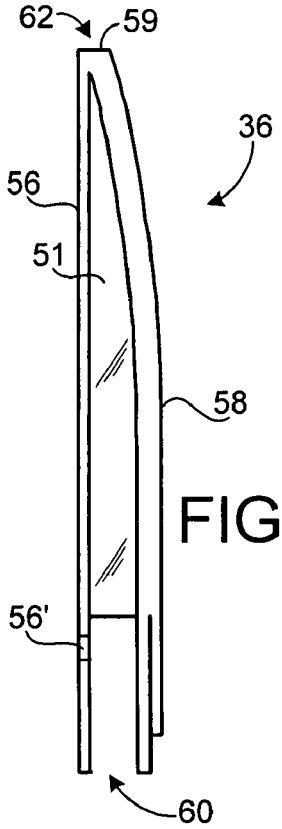
FIG. 12 is a side elevational view of a stash compartment forming part of the footwear item of FIG. 1.
Figure 13:
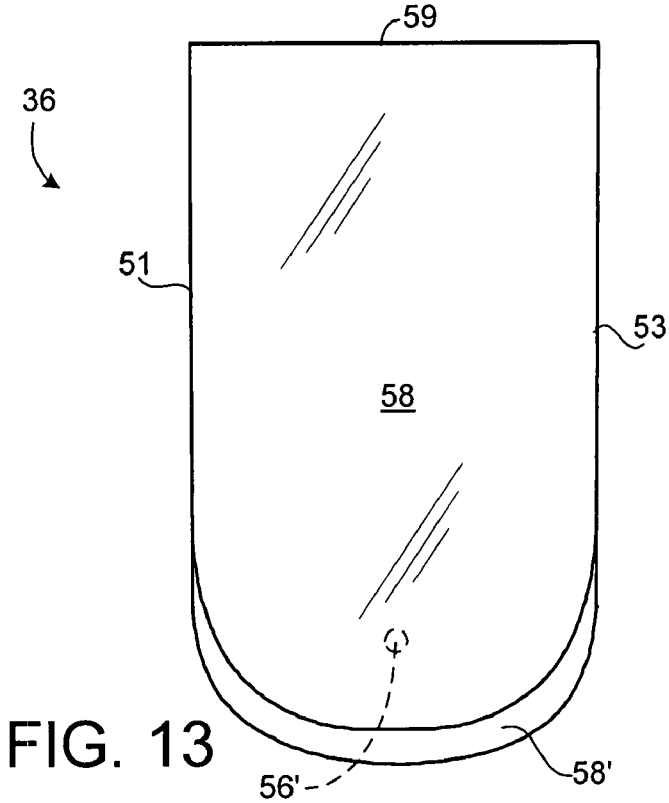
FIG. 13 is a top plan view of the stash compartment of FIG. 12.
Figure 14:
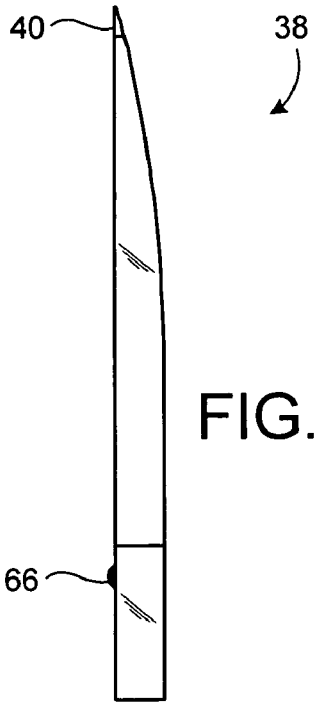
FIG. 14 is a side elevational view of a stash drawer forming part of the footwear item of FIG. 1.

Considering now the box 36 in greater detail with reference to FIGS. 12-13, the box 36 is generally rectangular in shape except at about its distal end which is rounded to conform to the distal end shape of the mid-sole 24 and the retainer 35. To allow the box 36 to fit in snug engagement within the cutout 50 of the retainer 35, the cassette or box 36 has a generally planar bottom wall member 56. The upper surface of the bottom wall member 56, which is disposed within the interior of the box 36, is sufficiently smooth to support from below for sliding engagement the drawer 38. The bottom wall member 56 also includes a small circular cutout or hole, indicated generally at 56', which is dimensioned for receiving therein a generally semi-spherical shaped detent 66 which is disposed on the underside of the drawer 38 as best seen in FIG. 14. In this regard, when the drawer 38 is slide into the interior of the box 36, the detent 66 will align and snap into the hole 56', thereby locking the drawer 38 into place within the box 36. The detent 66 is sufficient small, to allow a user to grasp distal end of the drawer 38, between his or her fingers, and pull the drawer 38 rearwardly to disengage the detent 66 from within the cutout 56'.

The box 36 also includes a top wall member 58 that is parallel to the bottom wall member 56 over a substantial portion of its overall longitudinal length, extending from its distal end indicated generally at 60 toward it proximate end, indicated generally at 62. However, as the top wall 58 approaches its proximate end, it drops closer and closer to the bottom wall member 56 to form a narrow passageway indicated generally at P within the box 36. The bottom wall member 56 and the top wall member 58 both terminate in a front wall member 59 which is disposed at the proximal end of the box 36. This is an important feature of the present invention as this allows the box 36 to conform to the shape of the retainer 35, and also allows the formation of a passageway P within the box 36 that limit the forward motion of the drawer 38 as it slides into the box 38 so that the teeth of the comb 40, which are arranged in a series of closely spaced peaks and valleys as best seen in FIG. 15, are not broken by engagement with the front wall 59. This structure also provides the box 36 with a smooth upper surface area for supporting from below the heel portion of the mid-sole 24.

Figure 20:
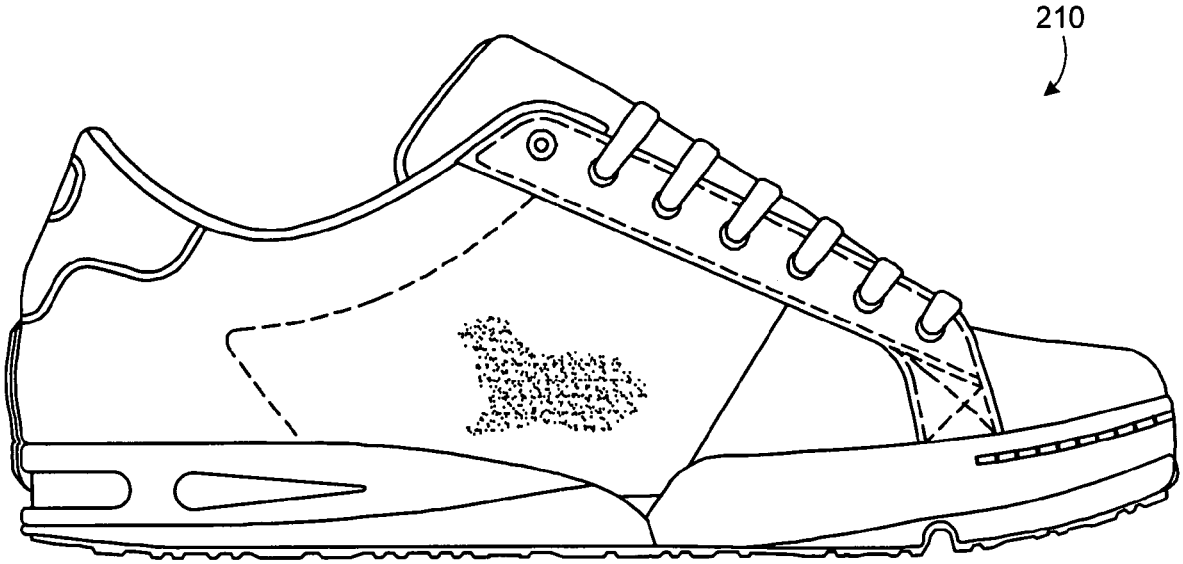
FIG. 20 is a right-side elevational view of another novelty footwear item, which is constructed in accordance with a preferred embodiment the present invention.

It is evident that there are additional embodiments and applications of the new and improved novelty footwear item which are not disclosed in this detailed description, but which would clearly fall with the scope of said invention. For example, although the footwear 10 is illustrated as a sandal, it will be understood by those skilled in the art that other types and kinds of footwear could also be utilized to include such a novelty stash. For example, the novelty footwear could be configured in the form of a shoe, such as the shoe 210 as illustrated in FIG. 20 instead of a sandal. As another example, the preferred embodiment of the present invention describes the stash as being located in the heel portion of the footwear so the drawer can be extracted rearwardly from the heel. It is contemplated that the stash compartment may be disposed in other locations of the footwear, such as at the arch support or in the front toe area of the footwear for forward drawer extractions and sideway drawer extraction. Based on the foregoing, this specification is intended therefore to illustrate and clarify the nature of this invention and not limit its scope.

We claim:

1. A novelty footwear item, comprising:

a mid-sole foot platform for supporting from below the foot of a user;

an outer sole for providing the footwear item with turning traction; and a stash assembly sandwiched between said mid-sole foot platform and said outer sole, wherein said stash assembly has disposed therein a slidably removable surfboard wax comb having a plurality of peaks and valleys for defining a set of closely spaced teeth.

2. The novelty footwear item according to claim 1, wherein said slidably removable surfboard wax comb is a stash drawer having sufficient length, width and depth dimensions for the storage of loose items.

3. The novelty footwear item according to claim 2, wherein said stash assembly includes a soft flexible retainer having a plurality of decorative windows for providing the footwear item with an ornamental appearance.

4. The novelty footwear item according to claim 3, wherein said stash assembly further includes an ornamental insert adapted to be received within said retainer for providing the novelty footwear item with a decorative heel and arch support; and wherein said ornamental insert is a compartment for receiving slidably therein said stash drawer.

5. The novelty footwear item according to claim 2, wherein said stash assembly provides an arch support for the novelty footwear item.

6. The novelty footwear item according to claim 5, wherein said stash assembly further provides a heel support for the novelty footwear item.

7. A novelty footwear item, comprising:

a mid-sole foot platform for supporting from below the foot of a user;

an outer sole for providing the footwear item with turning traction; and a stash assembly sandwiched between said mid-sole foot platform and said outer sole, wherein said stash assembly has disposed therein a slidably removable surfboard wax comb;

wherein said slidably removable surfboard wax comb is a stash drawer having sufficient length, width and death dimensions for the storage of loose items;

wherein said stash assembly provides an arch support for the novelty footwear item;

wherein said stash assembly further provides a heel support for the novelty footwear item; and wherein said stash assembly includes:

a soft flexible retainer having a plurality of decorative windows for providing the footwear with an ornamental appearance.

8. The novelty footwear item according to claim 7, wherein said stash assembly includes:

an ornamental insert adapted to be received within said retainer for providing the novelty footwear item with a decorative heel and arch support; and wherein said ornamental insert is a compartment for receiving slidably therein said stash drawer.

9. The novelty footwear item according to claim 8, further comprising;

a foot strap attached to an underside of said mid-sole for facilitating holding the foot of a user to said mid-sole foot platform.

10. A novelty footwear construction, comprising:

a mid sole for supporting from below the foot of a user;

a strap support for holding the foot of the user in engagement with said mid-sole;

a retainer for providing the footwear construction with a heel support and an arch support;

a stash compartment disposed within said retainer for further providing said footwear construction with said heel support and said arch support; and a stash drawer having sufficient depth, length and width dimensions for being slidably received within said stash compartment to provide the footwear construction with a temporary storage area for loose items; and wherein said stash drawer includes an integrally formed comb having a plurality of peaks and valleys disposed at a distal end portion of said drawer.

11. A novelty footwear construction, comprising:

a mid sole for supporting from below the foot of a user;

a strap support for holding the foot of the user in engagement with said mid-sole;

a retainer for providing the footwear construction with a heel support and an arch support;

a stash compartment disposed within said retainer for further providing said footwear construction with said heel support and said arch support; and a stash drawer having sufficient depth, length and width dimensions for being slidably received within said stash compartment to provide the footwear construction with a temporary storage area for loose items;

wherein said stash drawer includes an integrally formed comb having a plurality of peaks and valleys disposed at a distal end portion of said drawer; and wherein said integrally formed comb is a surfboard wax comb.

12. The novelty footwear construction according to claim 11, wherein said footwear construction is a sandal construction.

13. The novelty footwear construction according to claim 12 wherein said sandal construction is either a right foot sandal construction or a left foot sandal construction.

14. The novelty footwear construction according to claim 11, wherein said footwear construction is a shoe construction.

15. The novelty footwear construction according to claim 14, wherein said shoe construction is either a right foot shoe construction or a left foot shoe construction.

16. A novelty footwear item, comprising:

a bottom construction;

an upper construction;

a drawer compartment;

a drawer dimensioned to be slidably received within said drawer compartment;

wherein said drawer compartment is sandwiched between said bottom and said upper; and wherein said drawer includes an integrally formed comb of closely spaced teeth.

17. The novelty footwear item according to claim 16, further comprising:

a retainer sandwiched between said bottom and said upper for helping to retain said drawer compartment sandwiched between said bottom and said upper.

18. The novelty footwear construction according to claim 17, wherein said closely spaced teeth include a plurality of peaks and valleys disposed at a distal end portion of said drawer.

19. The novelty footwear construction according to claim 18, wherein said integrally formed comb is a surfboard wax comb.

20. The novelty footwear construction according to claim 19, wherein said retainer and said drawer compartment and said drawer in combination provide the novelty footwear with an ornamental decorative appearance.

21. The novelty footwear construction according to claim 20 further comprising:

a drawer strap adapted to be removably attached to said stash drawer for helping a user to slidably remove said stash drawer from within the drawer compartment.

* * * * *